US009466442B2

(12) United States Patent
Santos et al.

(10) Patent No.: US 9,466,442 B2
(45) Date of Patent: Oct. 11, 2016

(54) LOCKING SWITCH WITH COVER HAVING ACCESS AND NON-ACCESS CONFIGURATION

(71) Applicant: ROCKWELL AUTOMATION TECHNOLOGIES, INC., Mayfield Heights, OH (US)

(72) Inventors: Roberto S. Santos, Hudson, MA (US); Elik I. Fooks, Lexington, WI (US)

(73) Assignee: ROCKWELL AUTOMATION TECHNOLOGIES, INC., Mayfield Heights, OH (US)

( * ) Notice: Subject to any disclaimer, the term of this patent is extended or adjusted under 35 U.S.C. 154(b) by 30 days.

(21) Appl. No.: 14/539,791

(22) Filed: Nov. 12, 2014

(65) Prior Publication Data

US 2015/0129396 A1 May 14, 2015

Related U.S. Application Data

(60) Provisional application No. 61/903,351, filed on Nov. 12, 2013.

(51) Int. Cl.

| | |
|---|---|
| ***H01H 9/28*** | (2006.01) |
| ***H01H 13/50*** | (2006.01) |
| ***H01H 13/04*** | (2006.01) |

(52) U.S. Cl.

CPC ..... *H01H 9/285* (2013.01); *H01H 9/287* (2013.01); *H01H 13/04* (2013.01); *H01H 13/50* (2013.01); *H01H 2223/044* (2013.01)

(58) Field of Classification Search

CPC ..... H01H 9/285; H01H 9/287
USPC ..... 200/43.18, 43.16, 43.19, 43.21, 43.11
See application file for complete search history.

(56) References Cited

U.S. PATENT DOCUMENTS

| | | | | |
|---|---|---|---|---|
| 5,191,171 | A | 3/1993 | Bordwell | |
| 6,118,088 | A * | 9/2000 | Thielman | H01H 9/286 200/321 |
| 7,575,122 | B2 | 8/2009 | Hull et al. | |
| 8,026,455 | B2 * | 9/2011 | Liu | H01H 9/287 200/302.1 |
| 2012/0047973 | A1 | 3/2012 | Su et al. | |

* cited by examiner

*Primary Examiner* — Vanessa Girardi
(74) *Attorney, Agent, or Firm* — Viksnins Harris & Padys PLLP

(57) ABSTRACT

A locking switch assembly includes a locking switch having a locking plunger, and an actuator has a housing and a cover. The actuator has a through hole, and the through hole receives the locking plunger. The actuator having a non-access mode and an access mode, and at least one of the housing or the cover is configured to change from the non-access mode to the access mode. The housing or the cover has a cap, and at least a portion of the cap prevents access to the through hole in the non-access mode.

18 Claims, 20 Drawing Sheets

LOCKING SWITCH WITH COVER HAVING ACCESS AND NON-ACCESS CONFIGURATION

PRIORITY OF INVENTION

This application claims priority to U.S. Provisional Application No. 61/903,351 that was filed on 12 Nov. 2013. The entire content of this provisional application is hereby incorporated herein by reference.

TECHNICAL FIELD

The various embodiments described herein relate generally to control switches, such as locking switches for machine guarding applications, and more particularly relate to switches configured to change between different access modes.

BACKGROUND

Industrial locking switches are commonly used in a variety of safety applications to prevent unauthorized or unintended access into a hazardous area. Switching devices, for example, are used for controlling devices in technical installations in a manner to prevent human access to machines, such as presses and so forth. Typically, such switching devices are configured to facilitate partial or complete shutdown of electrically driven machines/devices of the technical installation to avoid or reduce the opportunities of access to equipment when operational.

In another example, a safety interlock sensor is used to detect that a machinery guard door is closed before the machine operates. Industrial locking switches can be mounted on the hazard or non-hazard side of the door. The hazard side being the side of the guard door within which a person may be injured by operating machinery and the non-hazard side being on the outside of the guard door where no threat of injury exists.

When a locking switch detects that the actuator is present, a command signal can be sent to extend a locking plunger from the switch into an orifice in the actuator, thereby mechanically coupling the two parts and locking the guard door. Any attempt to bypass the lock by removing the actuator will cause the equipment on the hazard side to automatically shut down.

The guard door prevents partial or full-body access into the hazard side. In this scenario, the switch is assembled to a mounting bracket on the hazard side of the guard door and the complementary actuator is likewise assembled to the hazard side of the guard door. In this application, mounting the switch and actuator on the hazard side of the guard door prevents a person from tampering or attempting to bypass the locking switch because the person has no direct access to the switch and actuator.

However, if a person were to get trapped on the hazard side, for example, he/she may have to exit the area quickly to avoid the hazard. Therefore, it would be beneficial if an integral emergency escape release were provided or if provisions were made to allow a person to manually push down the locking plunger with a finger.

SUMMARY

A locking switch assembly includes a locking switch having a locking plunger, and an actuator that has a housing and a cover. The actuator has a through hole, and the through hole receives the locking plunger. The actuator having a non-access mode and an access mode, and at least one of the housing or the cover is configured to change from the non-access mode to the access mode. At least a portion of the cap prevents access to the through hole in the non-access mode.

In one or more embodiments, a locking switch assembly includes a locking switch having a locking plunger, and an actuator that has a housing and a cover. The actuator has a through hole therein, and the through hole receives the locking plunger therein. The actuator has a non-access mode and an access mode. The housing is configured to change from a non-access mode to the access mode, and the housing has a cap, at least a portion of the cap prevents access to the through hole in the non-access mode. The assembly further includes one or more low force breakaway tabs coupled with at least a portion of the cap.

In one or more embodiments, a method of using a locking switch assembly is provided herein. The method includes presenting an actuator within the sensing distance of a locking switch. The locking switch has a locking plunger, and the actuator having a housing and a cover. The actuator has a through hole where the through hole receives the locking plunger therein. The actuator has a non-access mode and an access mode, where the cap is configured to change from a non-access mode to the access mode. At least one of the housing or the cover has a cap, and at least a portion of the cap prevents access to the through hole.

The method includes changing the cap from a non-access mode to the access mode, accessing the locking plunger of the locking switch, and disengaging the locking plunger from the actuator through hole.

Several options for the method are as follows. In one or more embodiments changing the cap from the non-access mode to the access mode includes disengaging one or more breakaway tabs between the cap and the housing, or disengaging one or more triangularly shaped breakaway tabs between the cap and the housing. In one or more embodiments, changing the cap from the non-access mode to the access mode includes twisting the cap relative to the housing, disposing a tool through the cap and pressing the plunger, or disposing a tool between the cap and the cover and pressing the plunger.

DETAILED DESCRIPTION

Figure 1:
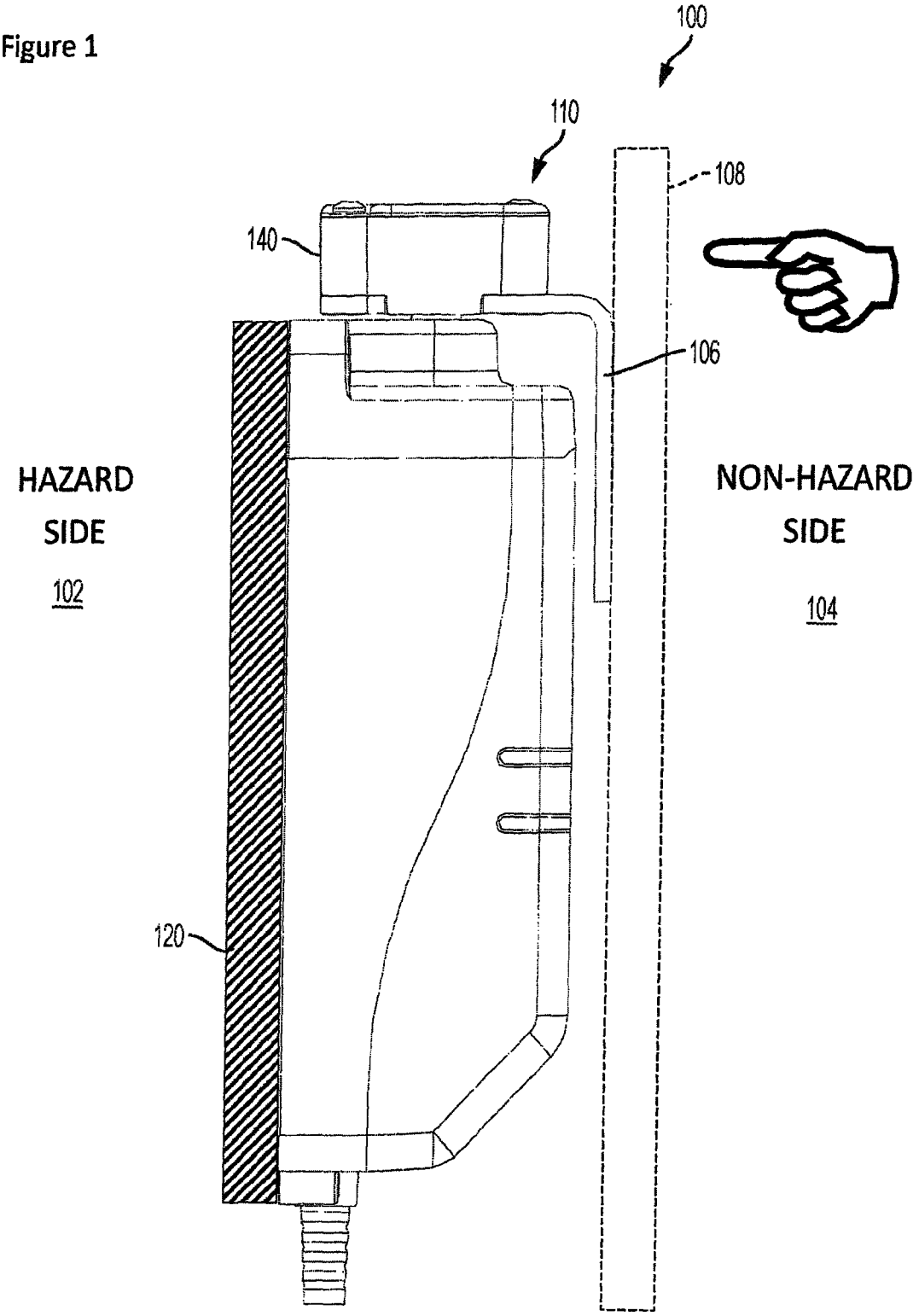
FIG. 1 illustrates a side view of a locking switch mounted on the hazard side of the door as constructed in one or more embodiments.

The following detailed description refers to the accompanying drawings that show, by way of illustration, specific details and embodiments in which the invention may be practiced. These embodiments, which are also referred to herein as "examples," or "options" are described in sufficient detail to enable those skilled in the art to practice the invention.

A system 100 including a locking switch assembly 110 that has an access mode and a non-access mode, and is configurable by an end user to change the control device from operating in the access mode to the non-access mode.

The locking switch assembly 110 can be used in a variety of safety applications to prevent unauthorized or unintended access into a hazardous area, to detect, for example, that a machinery guard door is closed before the machine operates. The locking switch assembly 110 can be mounted on the hazard or non-hazard side of the door, where the hazard side 102 is the side of the guard door within which a person may be injured by operating machinery and the non-hazard side 104 is on the outside of the guard door where no threat of injury from the machinery exists.

The locking switch assembly 110 includes a locking switch 120 and an actuator 140. When the locking switch 120 detects that the actuator 140 is present, a command signal can be sent to extend a locking plunger 130 from the switch into a through hole 152 in the actuator 140, thereby mechanically coupling the locking switch 120 and the actuator 140, and locking the guard door 108. Any attempt to bypass the lock by removing the actuator 140 will cause the equipment on the hazard side 102 to automatically shut down.

Referring to FIG. 1, an example of a locking switch assembly 110 is shown, including the locking switch 120 and associated actuator 140. The guard door 108 prevents partial, for example, hands/fingers, and prevents full-body access into the hazard side 102.

In one or more embodiments, for example, as shown in FIG. 1, the locking switch 120 is assembled to a mounting bracket 106 on the hazard side 102 of the guard door 108 and the complementary actuator 140 is likewise assembled to the hazard side 102 of the guard door 108. Mounting the switch 120 and actuator 140 on the hazard side 102 of the guard door 108 prevents a person from tampering or attempting to bypass the locking switch 120 because the person has no direct access to the switch and actuator 140.

If a person were to get trapped on the hazard side, for example, he/she may have to exit the area quickly to avoid the hazard. The locking switch assembly 110 provides a way for an emergency escape release, where the trapped person can access and move the locking plunger 130 (FIG. 18) to release the locking switch 120 and open the guard door 108 to escape.

Figure 2:
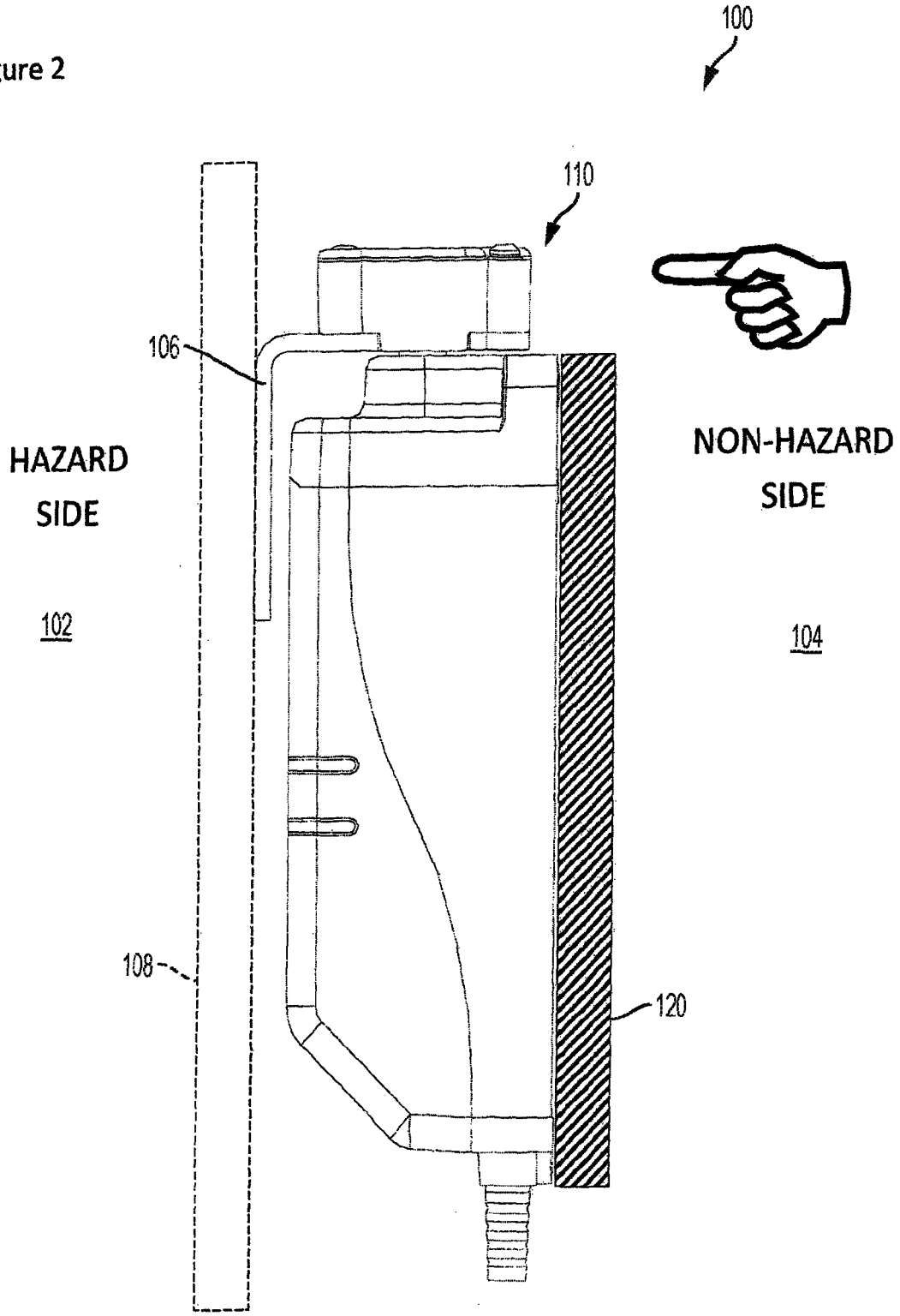
FIG. 2 illustrates a side view of a locking switch mounted on the non-hazard side of the door as constructed in one or more embodiments.

Referring to FIG. 2, another example of the locking switch assembly 110 and associated actuator is shown in one or more embodiments. The guard door 108 prevents partial or full-body access into the hazard side 102. The locking switch 120 is assembled to a mounting bracket 106 on the non-hazard side 104 of the guard door 108 and the complementary actuator 140 is likewise assembled to the non-hazard 104 side of the guard door 108.

Typically mounting an unprotected switch and actuator on the non-hazard side of the guard door allows a person to tamper or attempt to bypass the locking switch because the person has direct access to the switch and actuator. Although it is important to deter unwanted tampering, such as a person bypassing the lock by pushing down the locking plunger with a finger, the locking switch assembly 110 provides an auxiliary release so that a person is able to unlock the guard door in the event of unforeseen and uncommon circumstances. In one or more embodiments, the locking switch assembly 110 can be released with the use of a tool for instance instead of a finger. If power is supplied to the switch and the switch is in the locked state, operation of the auxiliary release will cause the switch to enter a fault condition.

A locking switch assembly 110 and related methods are provided herein. The locking switch assembly 110 preserves the ability to quickly escape from the hazard side while still restricting access when mounted on the non-hazard side.

The locking switch assembly 110, in one or more embodiments, includes an integral break away feature that allows it to be configured in-situ for use either on the hazard side of the guard door or on the non-hazard side of the guard door. With this approach, the end user only needs to order one part number; making it easier for the end user as they no longer need to know how many locking switches/actuators will be mounted on the hazard and non-hazard sides of the guard door; the end user only needs to know the total number of locking switches/actuators needed. Likewise, the end user only needs replacement stock of one actuator part number. The integral break away feature also allows for an emergency escape release to be fitted to the actuator housing.

Figure 9:
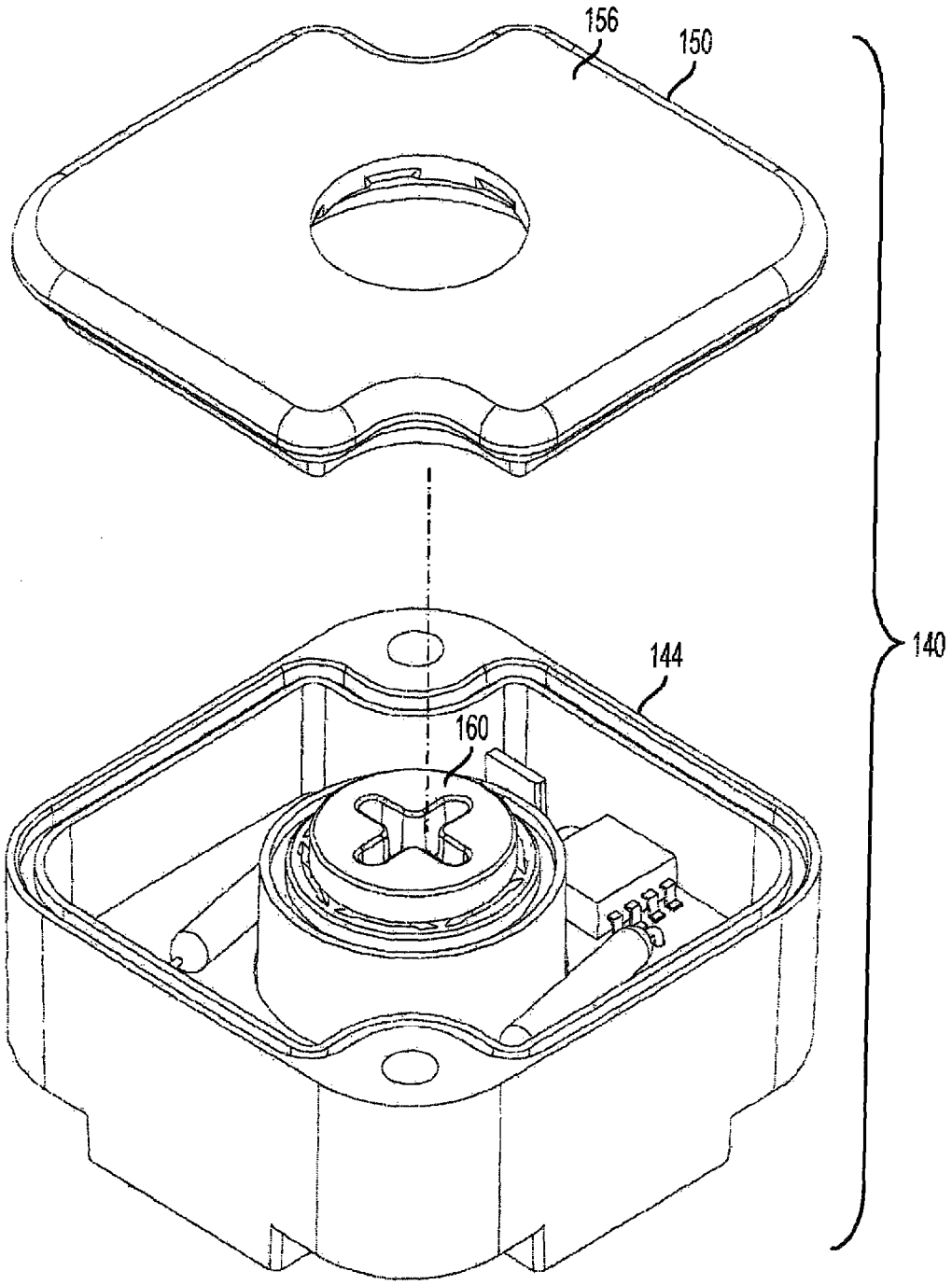
FIG. 9 is an exploded view showing the actuator cover and actuator housing as constructed in one or more embodiments.
Figure 18:
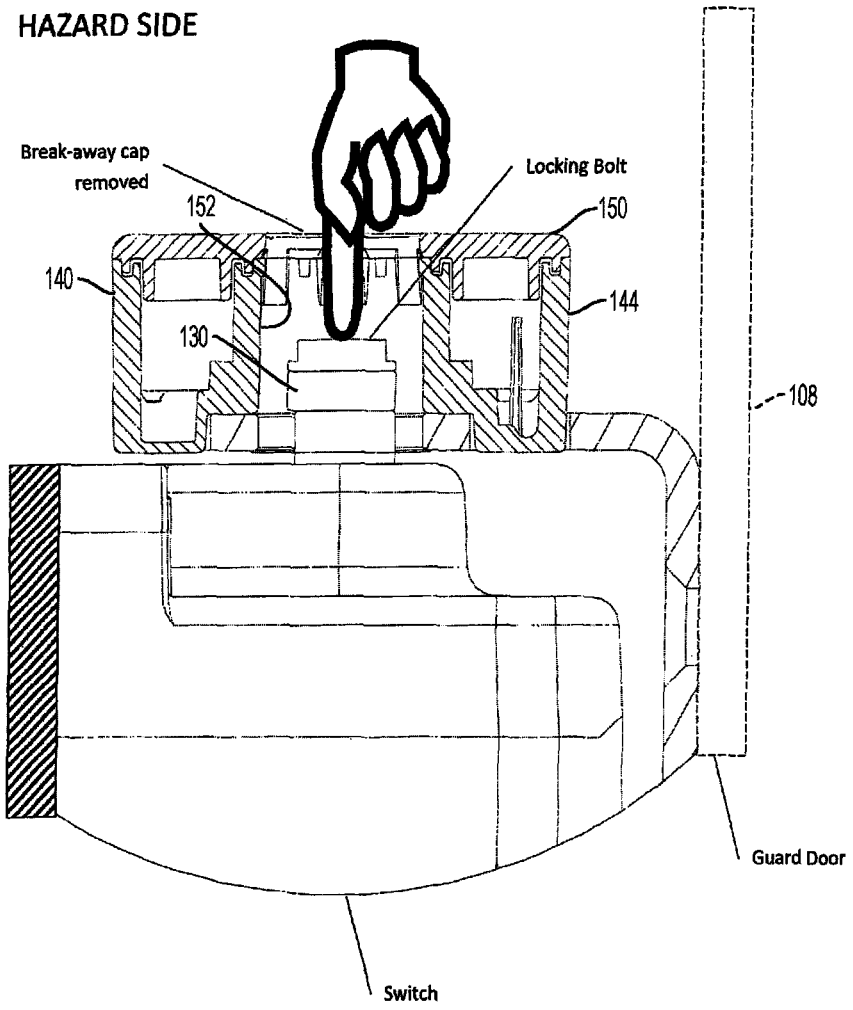
FIG. 18 is a partial sectional view of the switch and actuator with the breakaway cap removed as constructed in one or more embodiments.

In one or more embodiments, referring to FIGS. 9 and 18, a locking switch assembly 110 includes a locking switch 120 having a locking plunger 130 (FIG. 18), and an actuator 140 that has a housing 144 and a cover 150 (FIG. 9). The actuator 140 has a through hole 152, and the through hole 152 receives the locking plunger 130 (FIG. 18). The actuator 140 has a non-access mode and an access mode, and at least one of the housing 144 or the cover 150 is configured to change from the non-access mode to the access mode. At least a portion of the cap 160 prevents access to the through hole 152 in the non-access mode.

Figure 3:
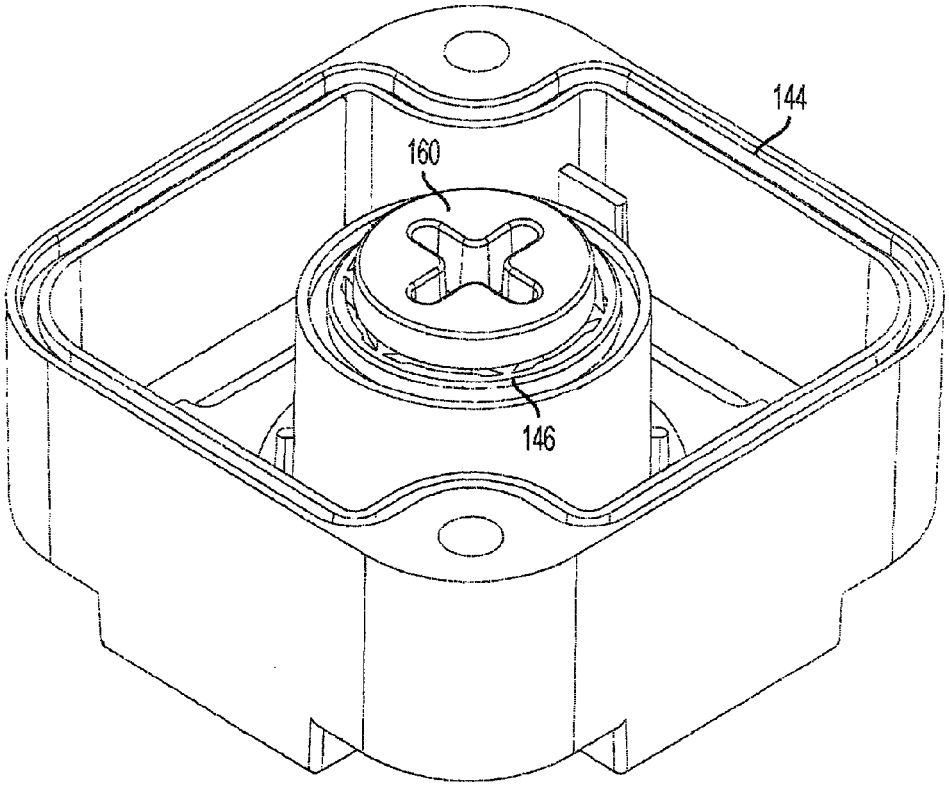
FIG. 3 is a top elevation isometric view of the actuator housing as constructed in one or more embodiments.

In one or more embodiments, a locking switch assembly 110 includes a locking switch 120 having a locking plunger 130, and an actuator 140 that has a housing 144 and a cover 150. The actuator 140 has a through hole 152 therein, and the through hole 152 receives the locking plunger 130 therein. The actuator 140 has a non-access mode and an access mode. The housing 144 is configured to change from a non-access mode to the access mode, and the housing 144 has a cap 160, at least a portion of the housing 144 prevents access to the through hole 152 in the non-access mode. The assembly 110 further includes one or more low force breakaway tabs 146 (FIG. 3) coupled with at least a portion of the housing 144. In one or more embodiments, the force to disengage the cap when pushing straight down on it, is about 50-55 lbs of force. In one or more embodiments, the force to twist the cap off is about 10-15 in-lbs of torque, such that the force to remove by twisting is much less than by pushing straight down on the cap. This can be beneficial as if the actuator is mounted on the non-hazard side of the guard door, it makes pushing the cap down to break it and access the locking bolt more difficult to do with a finger alone.

Referring to FIGS. 3-8, the actuator housing 144 is shown in greater detail. In one or more embodiments, the actuator housing 144 is made of unfilled ABS plastic, although other polymeric materials may also be used, which also protects the actuator electronics. A PCB sits flush on a series of support ribs in the bottom of the housing 144. In one or more embodiments, a vertical keying feature prevents the PCB from being installed incorrectly.

The actuator housing 144 has a through hole 152 that is larger than the plunger 130. In one or more embodiments, the through hole 152 is about 5 mm greater than the diameter of the locking plunger 130 to provide for misalignment of the switch 120 and actuator 140 on the guard door 108.

In one or more embodiments, the through hole 152 is covered by an integral breakaway cap 160 on the side opposite where the locking plunger is inserted. The cap can be part of the housing 144 and/or the cover 150. The breakaway cap 160 is held in place over the through hole 152 with a coupling that is designed to sever at a low force. In one or more embodiments, the break away cap 160 is held at six attachment points, although more or fewer attachment points can also be used. In one or more embodiments, the attachment points have a triangular shape to allow for the cap to break at the narrowest part of the attachment point. The force required to remove the cap can be controlled via the number of attachment points that tie the breakaway cap to the wall, and/or a thickness of the tab connecting the cap to the housing. Fewer attachment points will result in a cap that requires less force to remove it while more attachment points will require more force to remove the breakaway cap 160.

In one or more embodiments, the cap 160 has a cross-shaped opening in its center to allow a Phillips or flathead screwdriver or similar tool to be inserted. The integral cap can be removed with a twisting, prying up, or pushing down motion with this tool, where the twisting, prying or pushing can occur relative to the housing 144. Although shown as a cross shape, different shapes could also be used as well, such as a slot.

In one or more embodiments, a center of the cross-shaped opening is large enough to allow for a tool of ≤Ø02.5 mm to be used to push the end of the locking plunger in an emergency and release the switch. The integral cap 160 prevents an end-user from pushing down the locking plunger with a finger when the switch and actuator are mounted on the non-hazard side of the guard door. When mounted on the hazard side of the guard door, the integral cap can be removed using a Phillips or flat head screw driver, for example, during installation to allow for an end-user to quickly push down the locking plunger with a finger and escape the hazard.

The cover 150 of the actuator 140 is sealed with the housing 144. In one or more embodiments, the housing 144 includes a glue joint to allow for a cover to be adhesively bonded to the housing 144. Although adhesive bonding is discussed, other assembly methods such as ultrasonic welding or fasteners with an O-ring or gasket seal can also be used to create a seal and prevent fluid ingress. In one or more embodiments, two diagonally opposed mounting holes sized for M3 screws are located outside of the glue joint.

Figure 4:
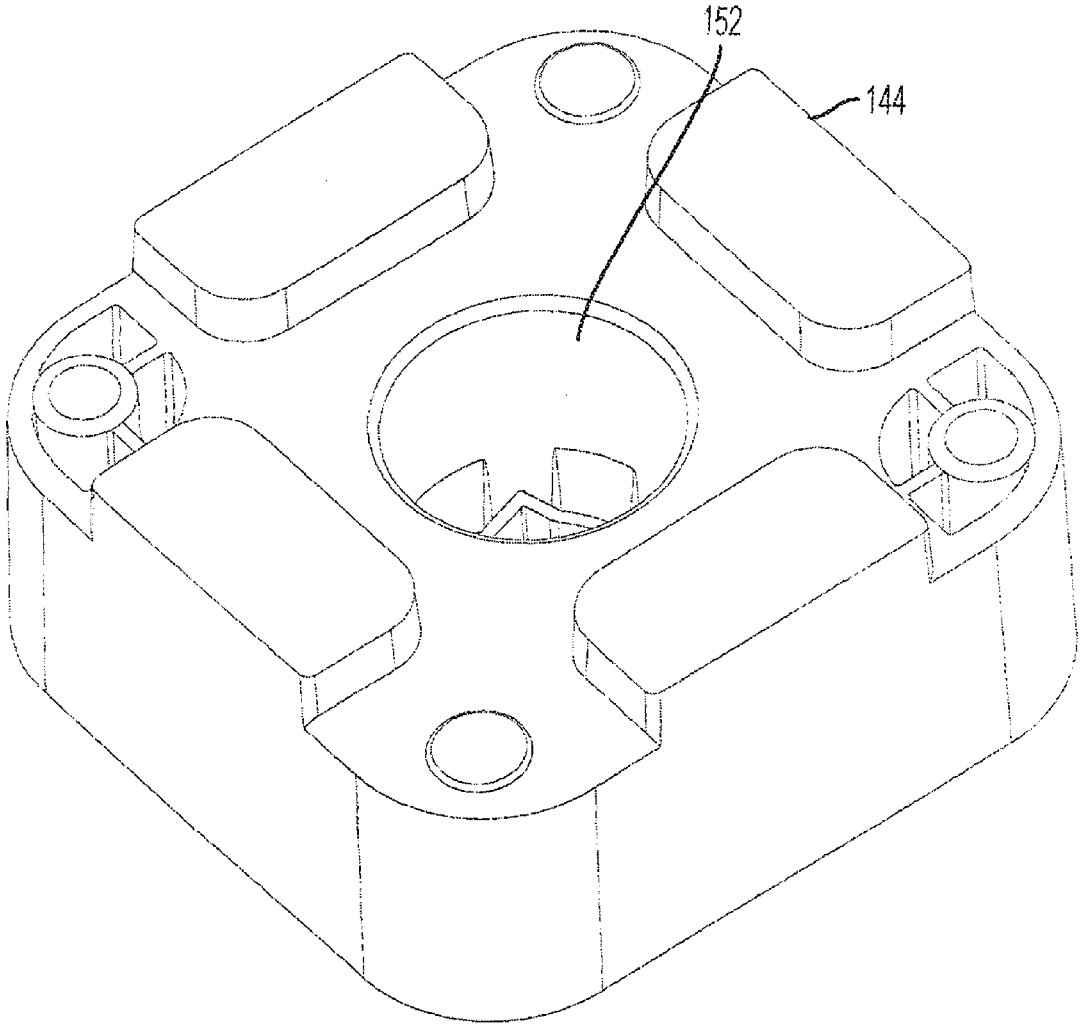
FIG. 4 is a bottom elevation isometric view of the actuator housing as constructed in one or more embodiments.
Figure 5:
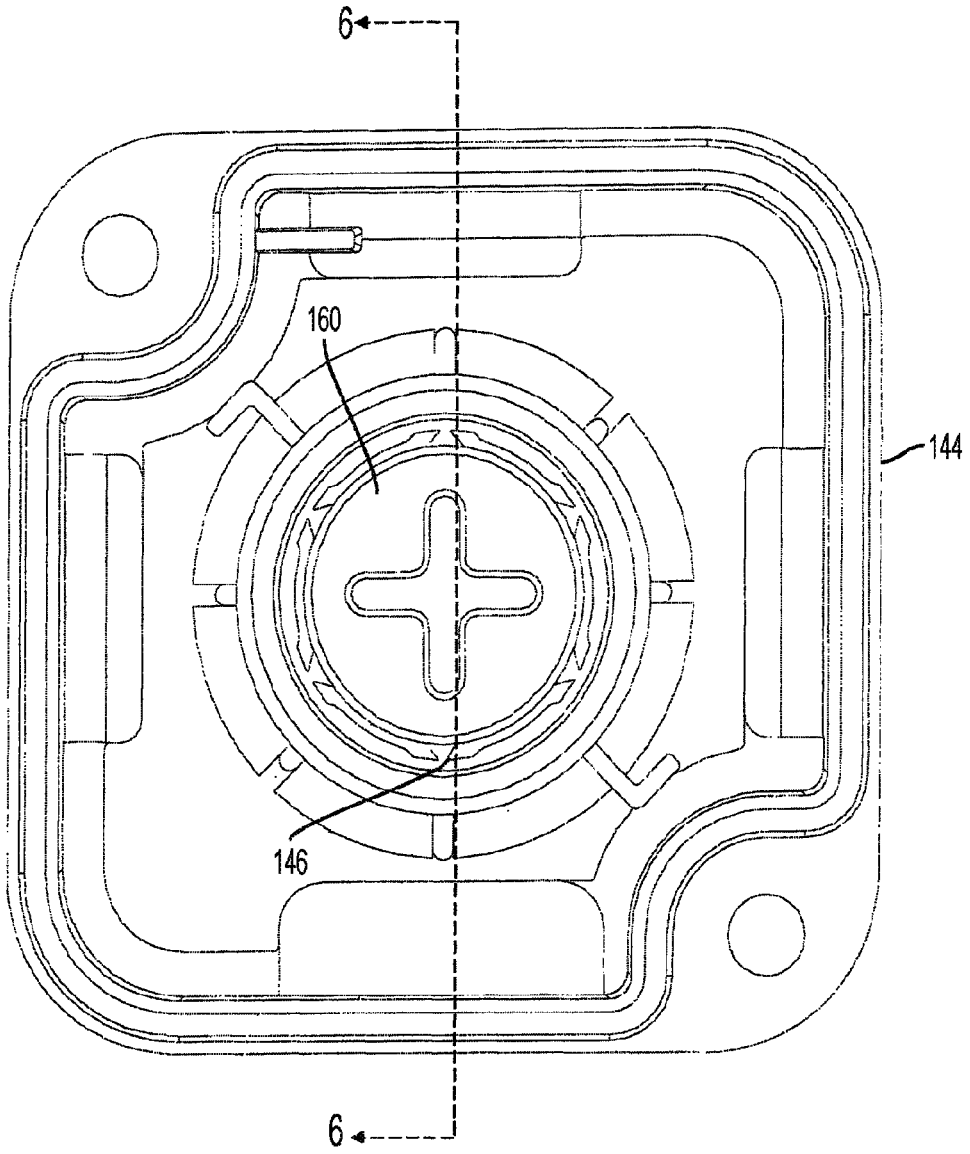
FIG. 5 is a top view of the actuator housing as constructed in one or more embodiments.
Figure 6:
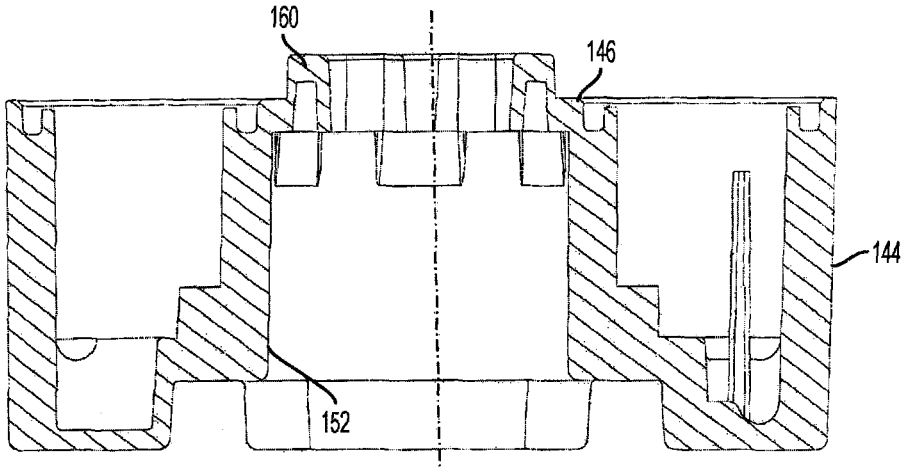
FIG. 6 is a cross-section of the actuator housing taken through 6-6 of FIG. 5 as constructed in one more embodiments.
Figure 7:
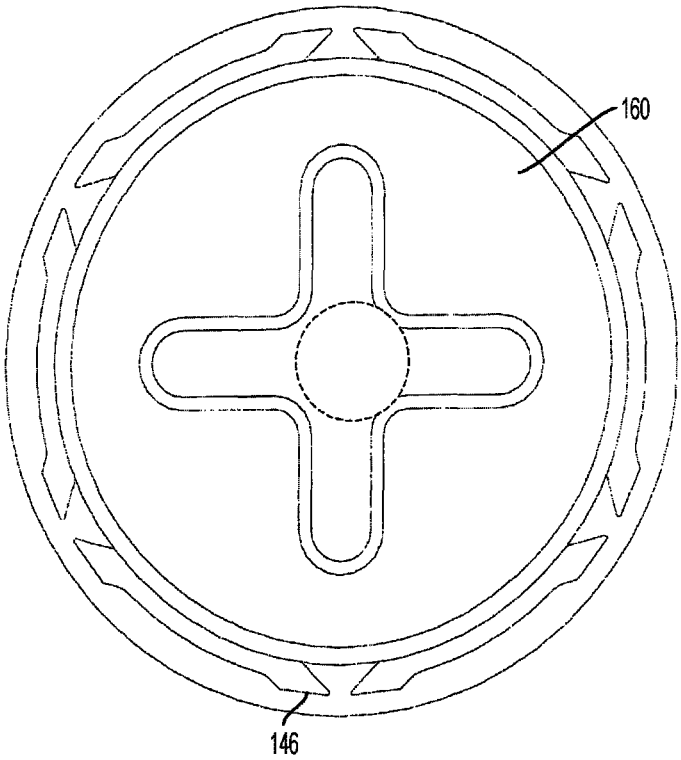
FIG. 7 is a detail of the top side of the actuator cap as constructed in one or more embodiments.
Figure 8:
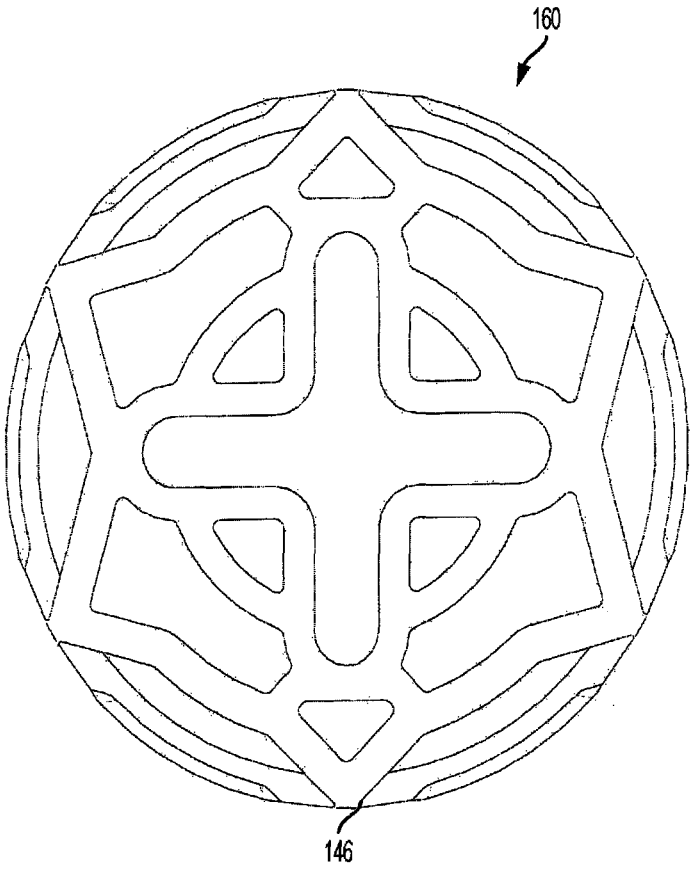
FIG. 8 is a detail of the bottom side of the actuator cap as constructed in one or more embodiments.

Referring to FIG. 4, four rectangular shaped protrusions extend from the bottom of the housing 144, in one or more embodiments. These protrusions are sized for the coil on the actuator PCB and allow the coil to stand off the PCB and partially into the pocket formed by coring out the protrusions. When mated to the actuator bracket, these protrusions minimize the possibility of dirt traps.

Referring to FIG. 9, a cover 150 is sized to fit with the housing 144. The cover 150, in one or more embodiments, includes an opening 156 therein. The opening 156 receives the cap 160 from the housing 144 therein. In one or more embodiments, the actuator cover 150 is made of unfilled ABS plastic, although another polymeric material can also be used, and is used to enclose the actuator.

In one or more embodiments, the cover 150 includes a tongue that interfaces with the housing glue joint to allow for the cover 150 to be adhesively bonded to the housing. Although adhesive bonding is discussed, other assembly methods such as ultrasonic welding or fasteners with an O-ring or gasket seal can also be used to create a seal and prevent fluid ingress. In one or more embodiments, two opposing corners of the cover have radii reliefs so that the actuator mounting screws do not interfere with the cover.

Figure 10:
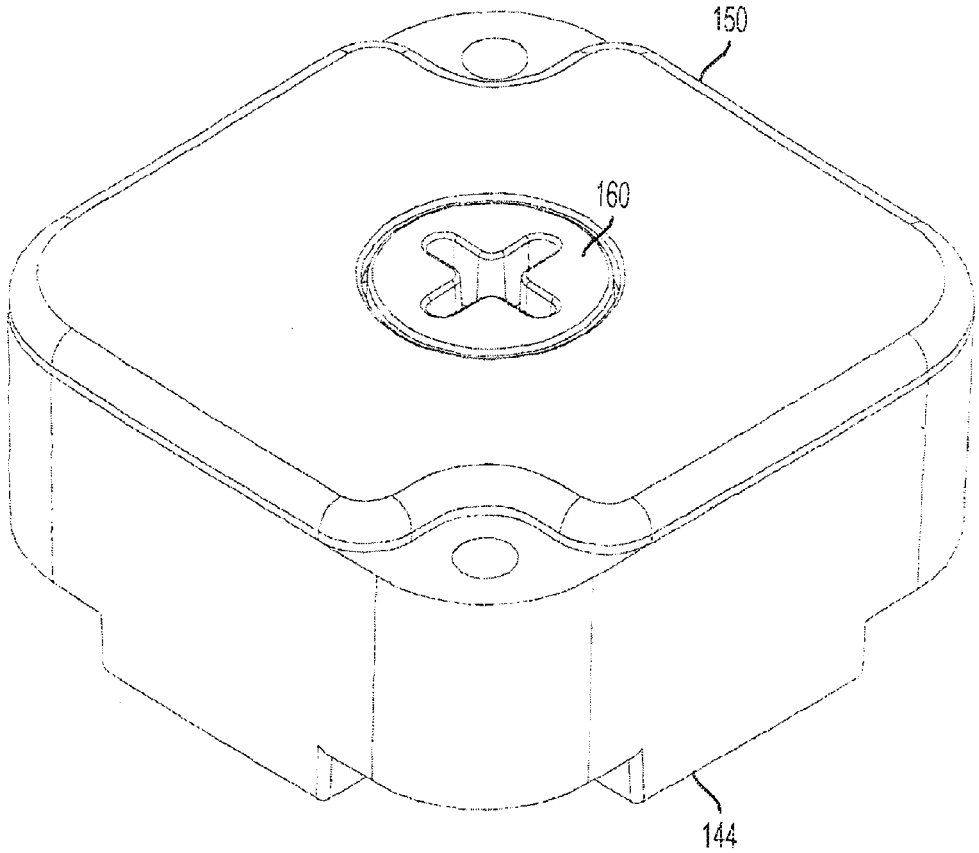
FIG. 10 shows an isometric view of the cover assembled to the housing as constructed in one or more embodiments.

FIG. 10 illustrates the cover 150 installed with the housing 144. After the cover 150 is installed onto the housing 144, the breakaway cap 160 sits flush with a top surface of the cover 150, in one or more embodiments.

Figure 11:
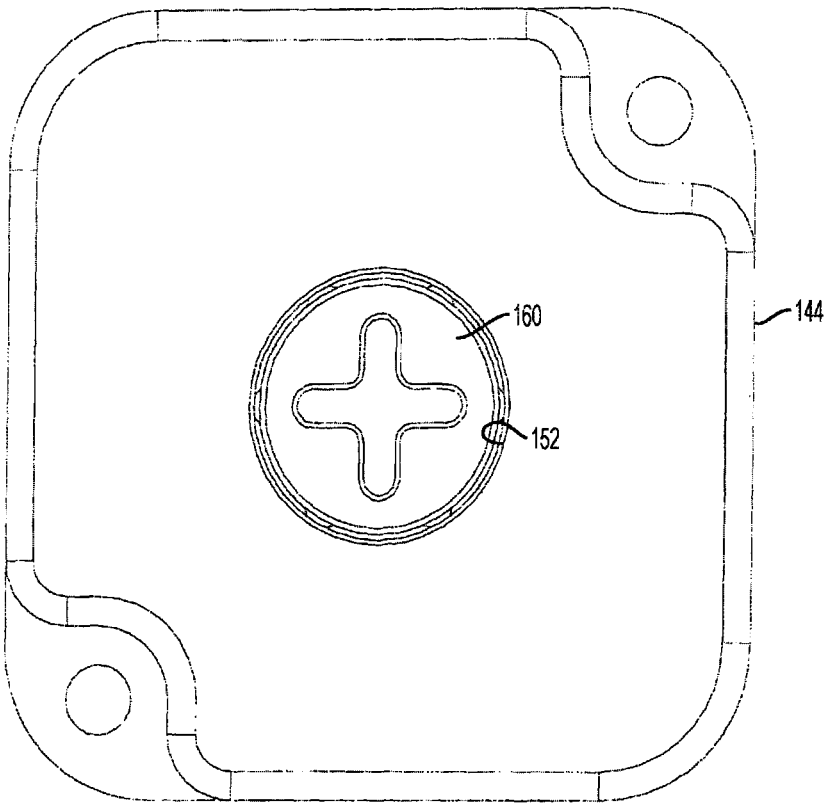
FIG. 11 shows a top view of the cover assembled to the housing as constructed in one or more embodiments.

Referring to FIG. 11, with the cover installed to the housing, the breakaway cap blocks the through hole 152 and prevents a person from bypassing the locking switch 120 (FIGS. 1, 2) by pushing down on the locking plunger 130 (FIG. 18) with their finger. However, in one or more embodiments, the cap 160 includes an opening that allows for a small tool that fits within the center of the cross-shaped opening. The tool can be used as an auxiliary release mechanism to push down on the locking plunger to unlock the guard door in the event of unforeseen and uncommon circumstances. This allows, for example, for the actuator 140 to be used on the non-hazard side of the guard door.

Figure 12:
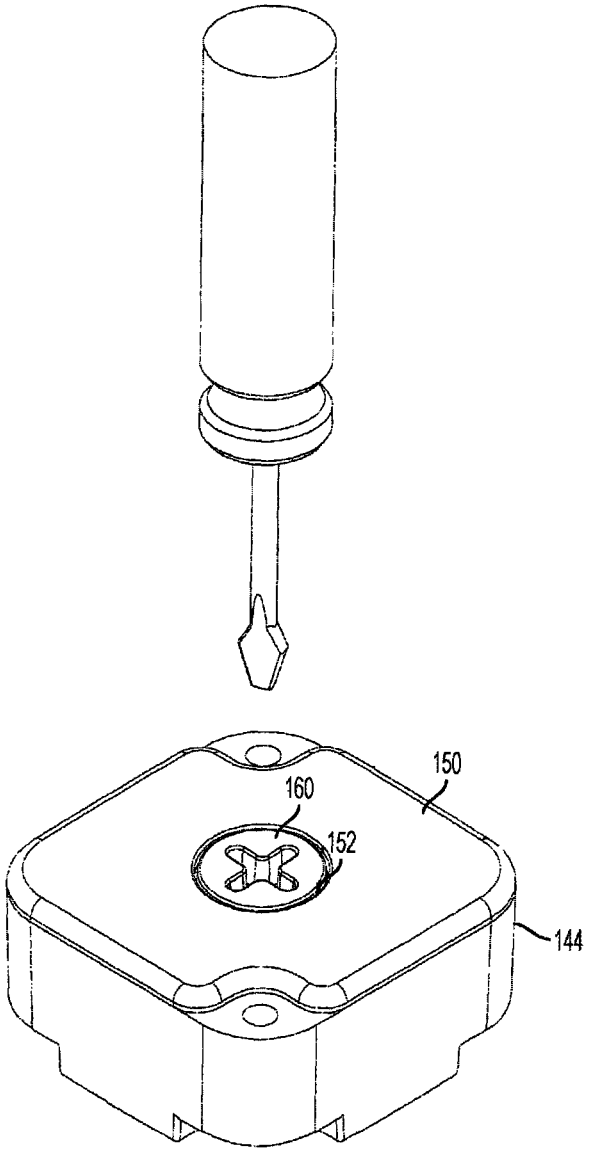
FIG. 12 illustrates an isometric view of a breakaway cap as constructed in one or more embodiments.

Referring to FIG. 12, to remove the breakaway cap, the end-user has only to insert a tool, such as a screwdriver into the slot and twist, pry, or push down with enough force to cause the attachment points to break, thus causing the cap to break off. The result is that the once covered through hole 152 is now no longer covered. In one or more embodiments, the break away cap is released with low force. When the cap is broken away from the housing, or the cover, the removal of the cap provides tamper evidence.

Figure 13:
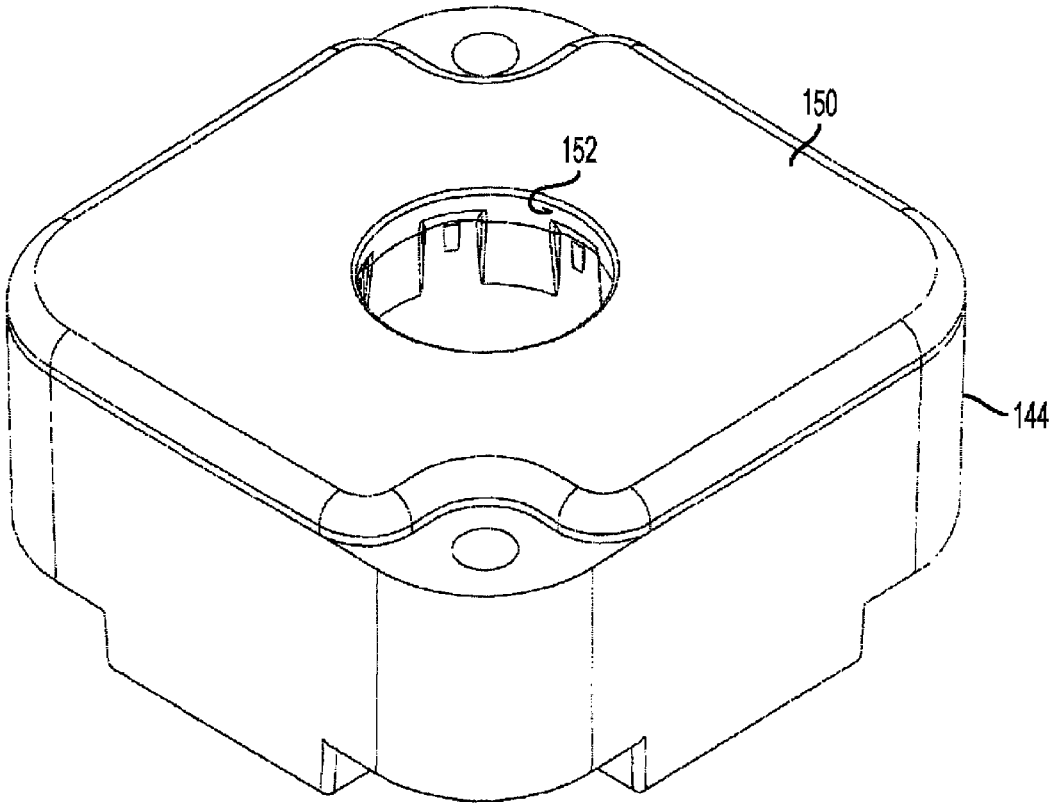
FIG. 13 shows an isometric view of the breakaway cap removed as constructed in one or more embodiments.
Figure 14:
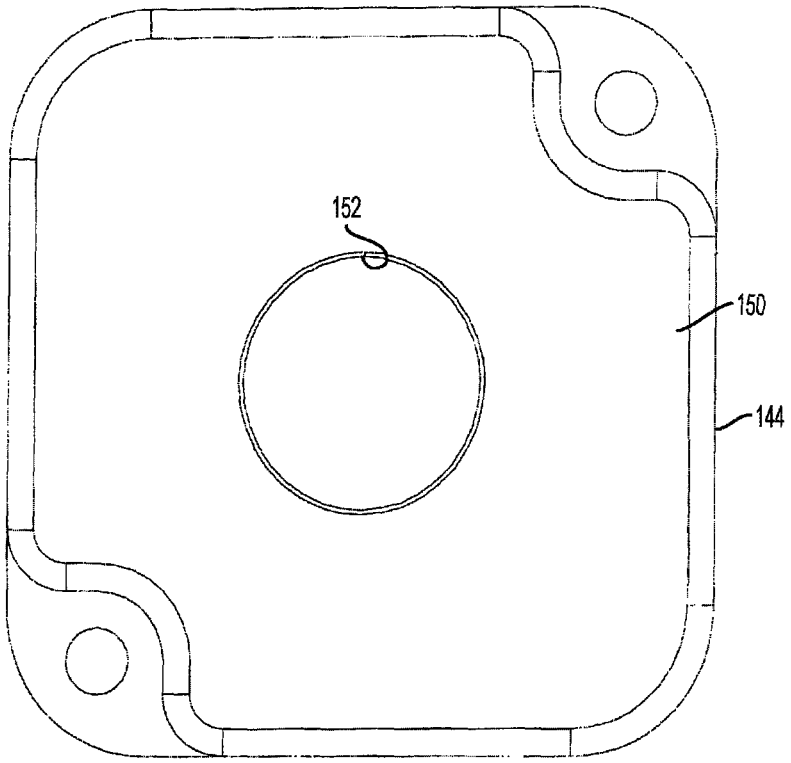
FIG. 14 shows a top view of the breakaway cap removed as constructed in one or more embodiments.

FIGS. 13 and 14 illustrate the actuator housing 144 and the cover 150 with the cap 160 removed. The through hole 152 is open and unobstructed. When mounted on the hazard side of the guard door, the unobstructed through hole 152 now allows for a person inside the hazard area to quickly press down on the locking plunger with a finger to unlock the guard door and exit.

In one or more embodiments, the breakaway cap may be broken out from the actuator if a through hole is required to prevent a food trap, for example when the locking switch assembly is mounted on the hazard side of a guard door. This is particularly useful in the food and beverage industry where the presence of a through hole makes it easier for any food debris that may find its way into the through hole 152 to be washed out by a high pressure fluid washdown.

In one or more embodiments, an inner surface of the through hole 152 has a recess therein, the recess is recessed away from a longitudinal axis of the through hole, the one or more breakaway tabs coupled with a surface of the through hole within the recessed portion. Burrs that may remain after the break away cap 160 is removed are recessed inside the recess or pockets in the surface so that end users will not cut themselves, for example, when inserting or removing a finger.

Figure 15:
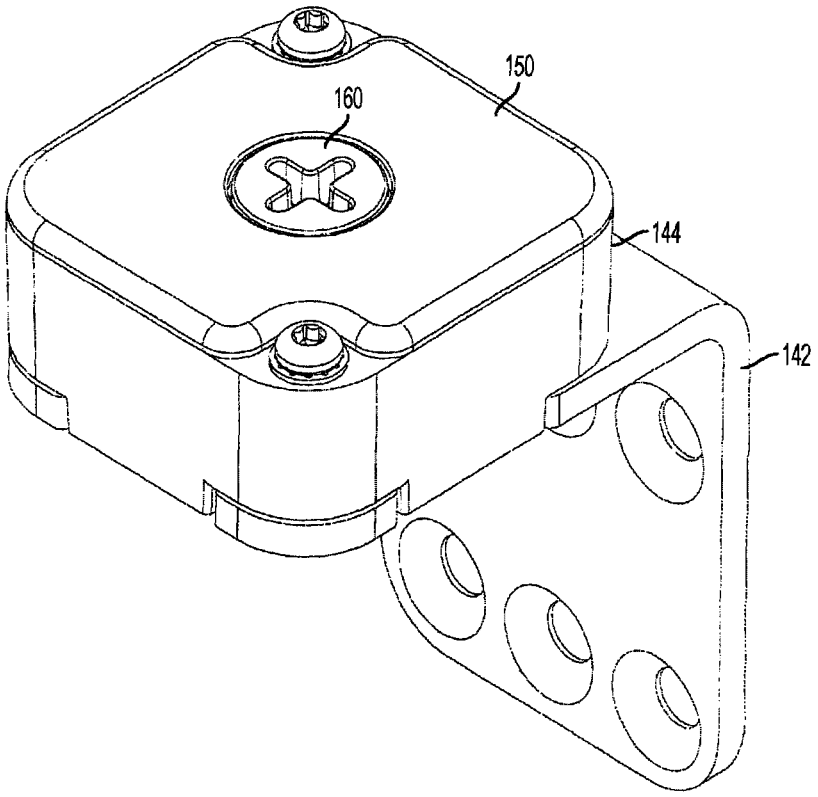
FIG. 15 is an isometric view of the actuator attached to its mounting bracket without the breakaway cap removed as constructed in one or more embodiments.
Figure 17:
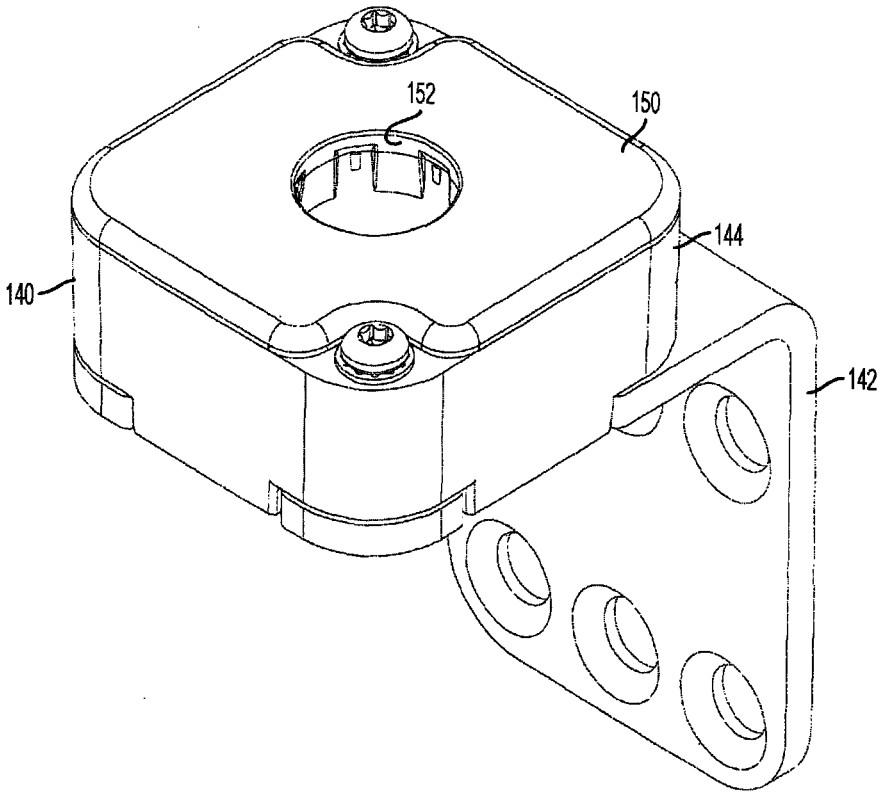
FIG. 17 is an isometric view of the actuator attached to its mounting bracket with the breakaway cap removed as constructed in one or more embodiments.

In FIGS. 15 and 17, the actuator 140 is attached to an actuator mounting bracket 142, for example, with the use of mechanical fasteners such as screws. The breakaway cap 160 can be removed either before or after installing the actuator 140 onto the bracket 142.

Figure 16:
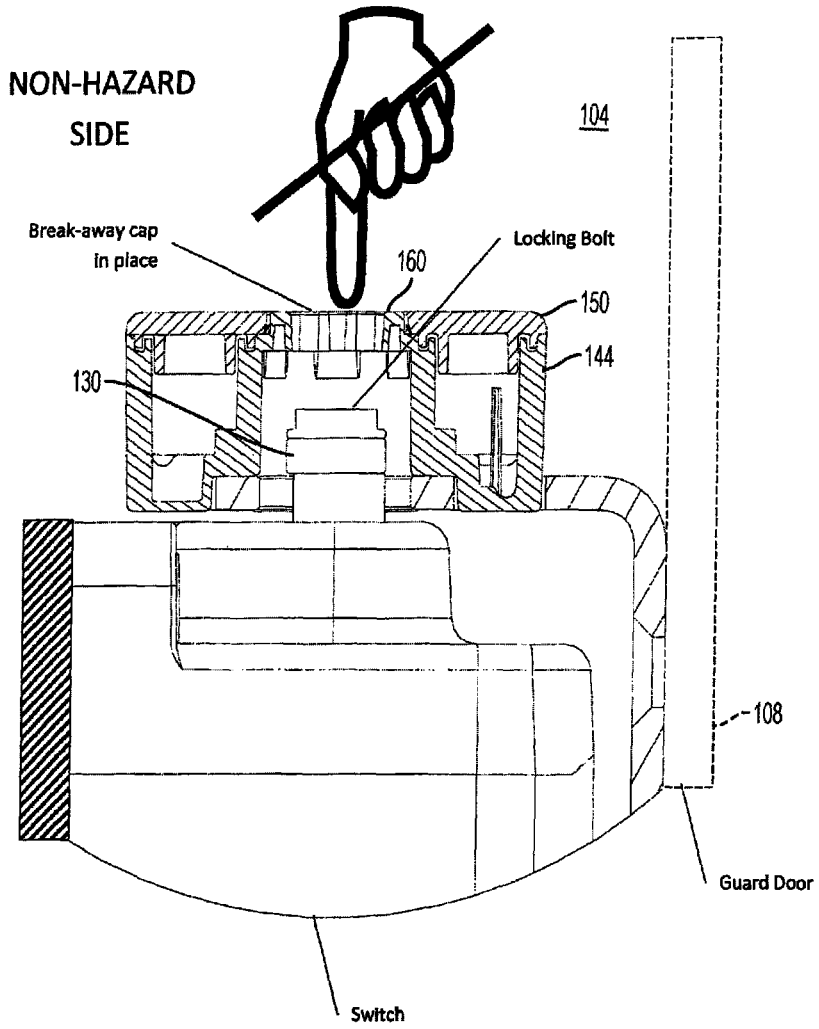
FIG. 16 is a partial sectional view of the switch and actuator without the breakaway cap removed as constructed in one or more embodiments.

FIG. 16 illustrates that when the locking switch assembly 110 is installed, for example on the non-hazard side 104 of the guard door 108, and with the breakaway cap 160 in place, the end-user cannot push down the switch locking plunger 130 to bypass the lock.

Referring to FIG. 18, when the locking switch assembly 110 is installed on the hazard side of the guard door 108, and the breakaway cap 160 is removed, the end-user can push down the switch locking plunger to bypass the lock and escape the hazard.

Figure 19:
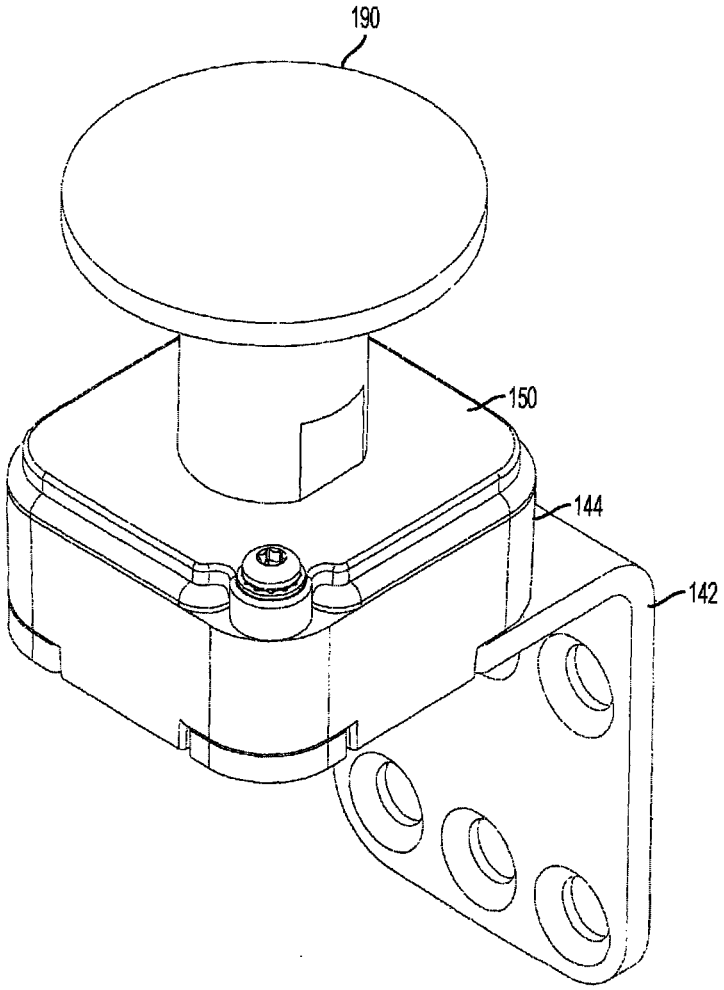
FIG. 19 is an isometric view of the actuator attached to its mounting bracket with the breakaway cap removed and an emergency release pushbutton installed as constructed in one or more embodiments.
Figure 20:
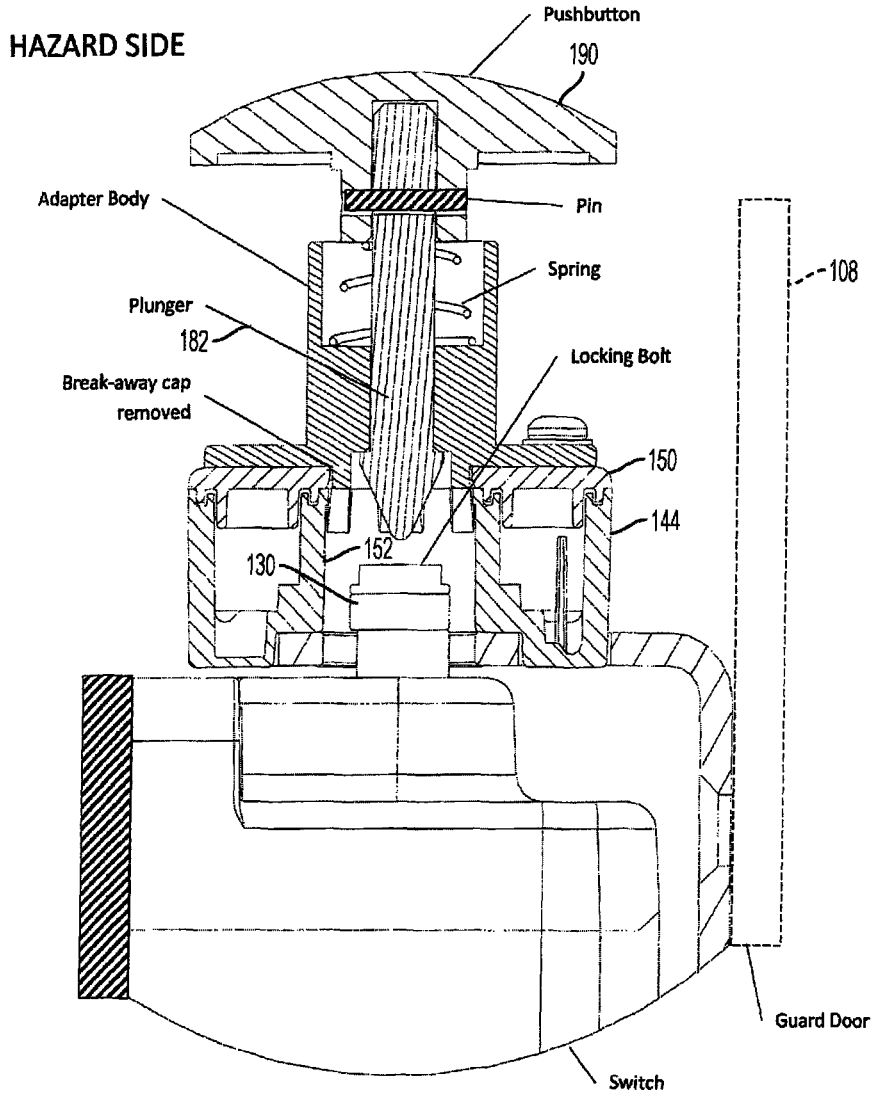
FIG. 20 is a partial sectional view of the switch and actuator without the breakaway cap removed and an emergency release pushbutton installed as constructed in one or more embodiments.

Referring to FIGS. 19 and 20, with the breakaway cap 160 removed, it is possible to adapt a pushbutton emergency release to the actuator housing 144. When installed on the hazard side of the guard door 108, for example, the pushbutton release allows for the end-user to escape the hazard simply by pushing down on a pushbutton 190, where the pushbutton has a larger diameter than the through hole and/or the plunger, allowing for ease of use in an emergency. This is beneficial as pressing the button is much easier and faster than putting ones finger in the hole and pressing down on the locking plunger. Furthermore, it allows for greater leverage to be applied when pressing the locking plunger down than one might be able to generate with a finger alone.

Mechanical fasteners, such as screws, hold the pushbutton emergency release to the actuator and actuator bracket. In one or more embodiments, the emergency release includes an adapter body that houses a plunger 182 movably disposed within the through hole 152, the plunger and plunger actuator 180 having a plunger actuator diameter greater than a through hole diameter. The assembly includes a pin to couple the pushbutton with the plunger 182.

When installed on the hazard side of the guard door and with the breakaway cap removed, the end-user can push down on the pushbutton emergency release to push down the switch locking plunger to bypass the lock and escape the hazard.

In one or more embodiments, a method of using a locking switch assembly is provided herein. The method includes presenting an actuator within the sensing distance of a locking switch. The locking switch has a locking plunger, and the actuator having a housing and a cover. The actuator has a through hole where the through hole receives the locking plunger therein. The actuator has a non-access mode and an access mode, where the cap is configured to change from a non-access mode to the access mode. At least one of the housing or the cover has a cap, and at least a portion of the cap prevents access to the through hole.

The method includes changing the cap from a non-access mode to the access mode, accessing the locking plunger of the locking switch, and disengaging the locking plunger from the actuator through hole.

Several options for the method are as follows. In one or more embodiments changing the cap from the non-access mode to the access mode includes disengaging one or more breakaway tabs between the cap and the housing, or disengaging one or more triangularly shaped breakaway tabs between the cap and the housing. In one or more embodiments, changing the cap from the non-access mode to the access mode includes twisting the cap relative to the housing, disposing a tool through the cap and pressing the plunger, or disposing a tool between the cap and the cover and pressing the plunger.

The above Detailed Description is intended to be illustrative, and not restrictive. The various embodiments are not necessarily mutually exclusive, as some embodiments can be combined with one or more other embodiments to form new embodiments. For example, the above-described embodiments (and/or aspects thereof) embodiments may be combined, utilized and derived therefrom, such that structural and logical substitutions and changes may be made without departing from the scope of this disclosure. Such embodiments of the inventive subject matter may be referred to herein, individually and/or collectively, by the term "invention" merely for convenience and without intending to voluntarily limit the scope of this application to any single invention or inventive concept if more than one is in fact disclosed. Many other embodiments will be apparent to those of skill in the art upon reviewing the above description. The scope of the invention should, therefore, be determined with reference to the appended claims, along with the full scope of equivalents to which such claims are entitled.

The methods described herein do not have to be executed in the order described, or in any particular order, unless it is otherwise specified that a particular order is required. Moreover, unless otherwise specified, various activities described with respect to the methods identified herein can be executed in repetitive, simultaneous, serial, or parallel fashion.

The terms "a" or "an" are used, as is common in patent documents, to include one or more than one. The term "or" is used to refer to a nonexclusive or, unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The Abstract of the Disclosure is provided to comply with 37 C.F.R. §1.72(b), requiring the abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment with each embodiment being combinable with each other embodiment.

What is claimed is:

1. A locking switch assembly, comprising:

a locking switch having a locking plunger;

an actuator having a housing and a cover;

the actuator having a through hole therein, the through hole receives the locking plunger therein;

the actuator having a non-access mode and an access mode;

at least one of the housing or the cover configured to change from the non-access mode to the access mode;

at least one of the housing or the cover having a cap, at least a portion of the cap prevents access to the through hole in the non-access mode;

the cap has an access hole therein; and one or more low force breakaway tabs coupled with at least a portion of the cap and the housing.

2. The locking switch assembly as recited in claim 1, wherein the one or more breakaway tabs have a triangular shape.

3. The locking switch assembly as recited in claim 1, wherein an inner surface of the through hole has a recess therein, the recess is recessed away from a longitudinal axis of the through hole, the one or more breakaway tabs coupled with a surface of the through hole within the recessed portion.

4. The locking switch assembly as recited in claim 1, wherein the housing has a breakaway cap.

5. The locking switch assembly as recited in claim 1, further comprising a plunger movably disposed within the through hole, the plunger having a pushbutton diameter greater than a through hole diameter.

6. The locking switch assembly as recited in claim 1, wherein a removal force to push and remove the cap is greater than a twist removal torque to remove the cap.

7. The locking switch assembly as recited in any of claim 1, wherein the cap has an access hole therein.

8. The locking switch assembly as recited in claim 7, wherein the access hole has a diameter less than 2.5 mm.

9. A locking switch assembly, comprising:

a locking switch having a locking plunger;

an actuator having a housing and a cover;

the actuator having a through hole therein, the through hole receives the locking plunger therein;

the actuator having a non-access mode and an access mode;

the housing configured to change from a non-access mode to the access mode;

the housing having a cap, at least a portion of the cap prevents access to the through hole in the non-access mode, wherein the cap has an access hole therein; and one or more low force breakaway tabs coupled with at least a portion of the cap.

10. The locking switch assembly as recited in claim 9, wherein an inner surface of the through hole has a recess therein, the recess is recessed away from a longitudinal axis of the through hole, the one or more breakaway tabs coupled with a surface of the through hole within the recessed portion.

11. The locking switch assembly as recited in claim 9, wherein the one or more breakaway tabs have a triangular shape.

12. The locking switch assembly as recited in claim 9, wherein the access hole has a diameter less than 2.5 mm.

13. A method comprising:

presenting an actuator within a distance of a locking switch, the locking switch having a locking plunger, the actuator having a housing and a cover; the actuator having a through hole therein, the through hole receives the locking plunger therein, the actuator having a non-access mode and an access mode, the cap configured to change from a non-access mode to the access mode, at least one of the housing or the cover having a cap, the cap has an access hole therein, at least a portion of the cap prevents access to the through hole;

changing the cap from a non-access mode to the access mode;

accessing the locking plunger of the locking switch; and disengaging the locking plunger from the actuator through hole; and changing the cap from the non-access mode to the access mode includes disengaging one or more breakaway tabs between the cap and the housing.

14. The method as recited in claim 13, wherein changing the cap from the non-access mode to the access mode includes disengaging one or more breakaway tabs between the cap and the housing.

15. The method as recited in claim 13, wherein changing the cap from the non-access mode to the access mode includes disengaging one or more triangularly shaped breakaway tabs between the cap and the housing.

16. The method as recited in claim 13, wherein changing the cap from the non-access mode to the access mode includes twisting the cap relative to the housing.

17. The method as recited in claim 13, wherein changing the cap from the non-access mode to the access mode includes disposing a tool through the cap.

18. The method as recited in claim 13, wherein changing the cap from the non-access mode to the access mode includes disposing a tool between the cap and the cover.

* * * * *